US006733245B2

(12) United States Patent
Oh et al.

(10) Patent No.: US 6,733,245 B2
(45) Date of Patent: May 11, 2004

(54) PISTON SUPPORT STRUCTURE OF RECIPROCATING COMPRESSOR

(75) Inventors: Won Sik Oh, Seoul (KR); Hyuk Lee, Siheung (KR); Gyoo Jong Bae, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/035,176

(22) Filed: Jan. 4, 2002

(65) Prior Publication Data

US 2003/0095879 A1 May 22, 2003

(30) Foreign Application Priority Data

Nov. 19, 2001 (KR) ..... 2001/0071930

(51) Int. Cl.[7] ..... F04B 19/00; F04B 17/00; F04B 17/04

(52) U.S. Cl. ..... 417/211; 417/415; 417/416; 417/417

(58) Field of Search ..... 417/415, 211, 417/416, 417

(56) References Cited

U.S. PATENT DOCUMENTS 3,813,192 A * 5/1974 Adams et al. ..... 417/416
3,814,550 A * 6/1974 Adams ..... 417/417
3,886,419 A * 5/1975 Omura et al. ..... 318/132
3,910,729 A * 10/1975 Jepsen et al. ..... 417/417
4,121,125 A * 10/1978 Dolz ..... 310/27

FOREIGN PATENT DOCUMENTS

JP 2001-73943 * 3/2001 ..... F04B/35/04
WO WO 02/095232 A1 * 11/2002 ..... F04B/35/04

OTHER PUBLICATIONS

Random House College Dictionary, Revised Edition, Random House, Inc., New York, 1984; pp. 294 and 936.*

* cited by examiner

*Primary Examiner*—Edward K. Look
*Assistant Examiner*—Timothy P. Solak
(74) *Attorney, Agent, or Firm*—Birch, Stewart, Kolasch & Birch, LLP

(57) ABSTRACT

A piston support structure for a reciprocating compressor is provided that includes a piston receiving a linear reciprocating driving power generated by a reciprocating motor. The piston is in a compression space formed in a cylinder and a first resonant spring and a second resonant spring are positioned on both sides of the piston. The first resonant spring and the second resonant spring elastically support the linear reciprocating motion of the piston. The spring constant of the second resonant spring opposite to the first resonant spring is larger than the spring constant of the first resonant spring positioned on the side of the compression space of the cylinder. Accordingly, the stress concentration of the second resonant springs for elastically supporting the piston is reduced. Accordingly, it is possible to prevent the fatigue of the second resonant springs and to extend the durability of the resonant springs.

1 Claim, 6 Drawing Sheets

PISTON SUPPORT STRUCTURE OF RECIPROCATING COMPRESSOR

BACKGROUND OF THE INVENTION

1. Field of the Invention

The present invention relates to a piston support structure of a reciprocating compressor, and more particularly, to a piston support structure of a reciprocating compressor which is positioned on both sides of a piston for receiving the linear reciprocating driving power of a reciprocating motor and compressing a gas while being in a linear reciprocating motion in the compression space of a cylinder. The piston support structure extends the durability of a resonant spring for elastically supporting the piston.

2. Description of the Background Art

In general, compressors for compressing fluid can be divided into rotary compressors, scroll compressors, and reciprocating compressors according to the respective method for compressing a refrigerant gas.

As shown in FIG. 1, an example of a reciprocating compressor includes a container 10 and a reciprocating motor 20 for generating linear reciprocating power loaded in the container 10. The compressor also includes a hind frame 30 and a central frame 40 for supporting both sides of the motor 20, a front frame 50 continuously combined with the central frame 40, a cylinder 60 fixedly combined with the front frame 50 so as to be separated from the reciprocating motor by a predetermined distance, and a piston 70 connected to the reciprocating motor 20 and inserted into the cylinder 60 to be in a linear reciprocating motion in the cylinder 60. The piston 70 also receives the linear reciprocating driving power of the reciprocating motor 20. The compressor also includes a valve unit 80 combined with the cylinder 60 and the piston 70. The valve unit 80 draws up a gas into the cylinder 60 and discharges the gas into the outside of the cylinder 60 due to the pressure difference generated by the reciprocation motion of the piston. A resonant spring unit 90 for elastically supporting the linear reciprocating motions of the reciprocating motor 20 and the piston 70 is also provided.

The reciprocating motor 20 includes a cylindrical outer stator 21 fixedly combined with the hind frame 30 and the central frame 40, an inner stator 22 inserted into the outer stator 21 to be separated from the outer stator 21 by a predetermined distance, a winding coil 23 combined with the outer stator 21 inside the outer stator 21, and a moving magnet A inserted between the outer stator 21 and the inner stator 22 to be in the linear reciprocating motion.

The moving magnet A includes a cylindrical magnet holder 24 and a plurality of permanent magnets 25 combined with the magnet holder 24 and separated from each other by a predetermined distance. The magnet holder 24 is connected to one side of the piston 70.

The valve unit 80 includes a discharge cover 81 for covering the compression space P of the cylinder 60 and a discharge valve 82 located in the discharge cover 81. The discharge valve 82 opens and closes the compression space P of the cylinder 60. The valve unit 80 also includes a valve spring 83 for elastically supporting the discharge valve 82 and a suction valve 84 combined with the end of the piston 70. The suction valve 84 opens and closes a suction channel F formed in the piston 70.

The refrigerant gas is drawn up into a suction pipe 1. The compressed refrigerant gas is discharged into a discharge pipe 2. The operation of the conventional reciprocating compressor will now be described in greater detail hereinafter.

When power is supplied to the reciprocating motor 20, current flows through the winding coil 23. The moving magnet A, including the permanent magnets 25, is in a linear reciprocating motion due to a mutual operation between the flux formed in the outer stator 21 and the inner stator 22 and the permanent magnets 25 due to the current that flows through the winding coil 23.

The linear reciprocating driving power of the moving magnet A is transmitted to the piston 70. Accordingly, the piston 70 has a linear reciprocating motion with a stroke that is the distance between a top dead center and a bottom dead center in the compression space P formed in the cylinder 60. The valve unit 80 operates at the same time as the piston 70. Accordingly, the refrigerant gas is sucked up into the compression space P of the cylinder 60, is compressed, and is discharged into the outside of the cylinder 60. The above processes are repeated.

The resonant spring unit 90 stores the linear reciprocating motion energy of the reciprocating motor 20 as elastic energy and emits the elastic energy. At the same time, the resonant spring unit 90 causes a resonant motion.

As shown in FIG. 2, the resonant spring unit 90, which causes the resonant motion with respect to the linear reciprocating motion of a driving portion including the moving magnet A of the reciprocating motor 20 and the piston 70 combined with the moving magnet A, is combined with one side of the piston 70. A spring supporter 91 formed to be bent so as to have a predetermined area is positioned between the front frame 50 and the central frame 40.

A first resonant spring 92 is inserted between the front frame 50 and the spring supporter 91. A second resonant spring 93 is inserted and combined between the spring supporter 91 and the central frame 40.

The elastic modulus of the first resonant spring 92 is the same as the elastic modulus of the second resonant spring 93. The first resonant spring 92 is combined with the second resonant spring 93 in a state where the first resonant spring 92 and the second resonant spring 93 are compressed to uniform lengths, respectively.

The first resonant spring 92 and the second resonant spring 93 are combined with each other so that the initial position f of the end of the piston 70 is moved from the center c between the maximum top dead center b and the maximum bottom dead center a toward the end d of the cylinder 60 by a predetermined distance, e.g., a movement distance e, considering gas spring force during compression.

Also, in the resonant spring unit 90, when the piston 70 moves toward the top dead center, the first resonant spring 92 contracts and the second resonant spring 93 is extended to be longer than the initial setting length. When the piston 70 moves toward the bottom dead center, the first resonant spring 92 is extended to be longer than the initial setting length and the second resonant spring contracts. The moving magnet A and the piston 70 are elastically supported by repeating the above processes.

However, according to the conventional reciprocating compressor, during the process of compressing the refrigerant gas with the reciprocating motion of the piston 70 in the compression space P in the cylinder 60, the gas spring force due to the increase in the pressure of the refrigerant gas compressed in the compression space P of the cylinder 60 is applied to the piston 70. Accordingly, since the end of the piston 70 is in the linear reciprocating motion between the top dead center and the bottom dead center in a state where the end of the piston 70 is moved from the initial position f positioned during setting toward the center position c of the maximum top dead center b and the maximum bottom dead center a, the compressing displacement of the second resonant spring 93 is larger than the compressing displacement of the first resonant spring 92.

Accordingly, the first resonant spring 92 receives less stress than the set stress, and the second resonant spring 93 receives more significant stress than the set stress. Therefore, the fatigue endurance of the second resonant spring 93 deteriorates to shorten the durability of the second resonant spring 93.

SUMMARY OF THE INVENTION

Therefore, an object of the present invention is to provide a piston support structure for a reciprocating compressor which is positioned on both sides of a piston for receiving the linear reciprocating driving power of a reciprocating motor and compressing a gas while being in a linear reciprocating motion in the compression space of a cylinder.

An object of the present invention is to provide a piston support structure for extending the durability of a resonant spring for elastically supporting the piston.

To achieve these and other advantages and in accordance with the purpose of the present invention, as embodied and broadly described herein, there is provided a piston support structure of a reciprocating compressor comprising a piston receiving linear reciprocating driving power generated by a reciprocating motor and being in a linear reciprocating motion in a compression space formed in a cylinder and a first resonant spring and a second resonant spring positioned on both sides of the piston, the first resonant spring and the second resonant spring for elastically supporting the linear reciprocating motion of the piston. The spring constant of the second resonant spring opposite to the first resonant spring is larger than the spring constant of the first resonant spring positioned on the side of the compression space of the cylinder.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
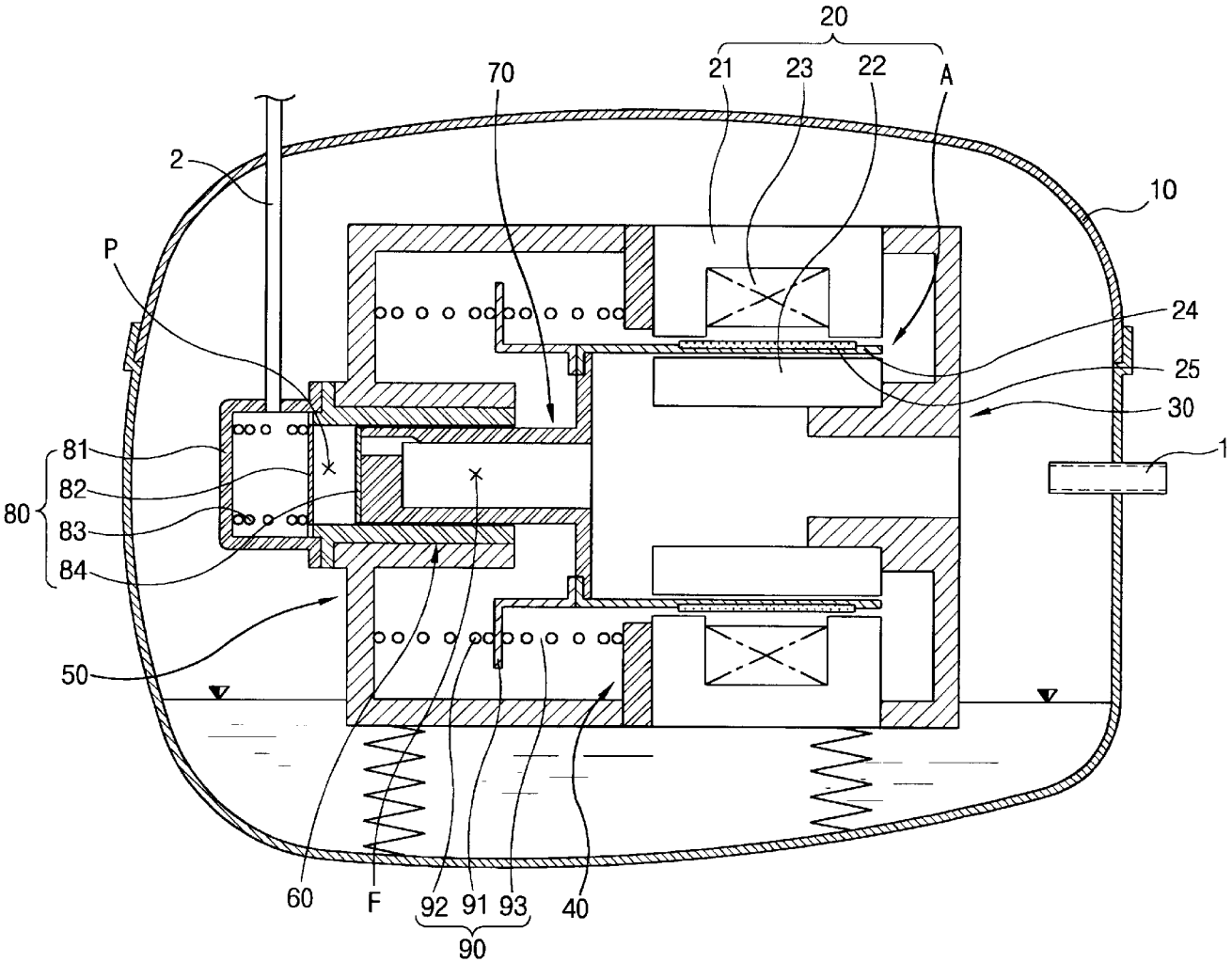
FIG. 1 CONVENTIONAL ART
FIG. 1 is a vertical sectional view of a conventional reciprocating compressor of the background art.
Figure 2:
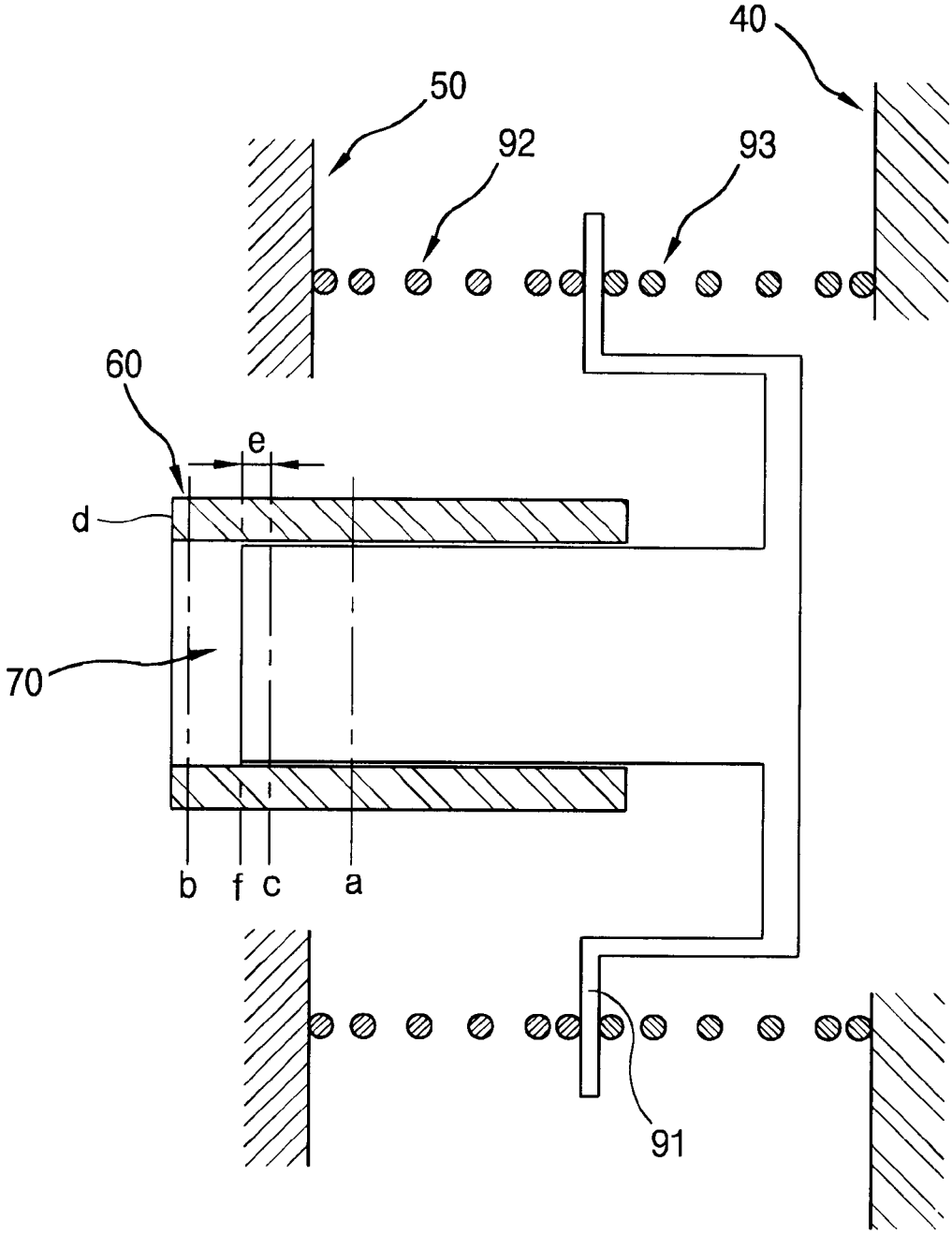
FIG.2 CONVENTIONAL ART
FIG. 2 is a partial sectional view showing a piston support structure of the conventional reciprocating compressor of the background art.

A piston support structure of a reciprocating compressor according to the present invention will now be described in detail with reference to embodiments shown in the attached drawings. The same reference numerals in different drawings represent the same element.

Figure 3:
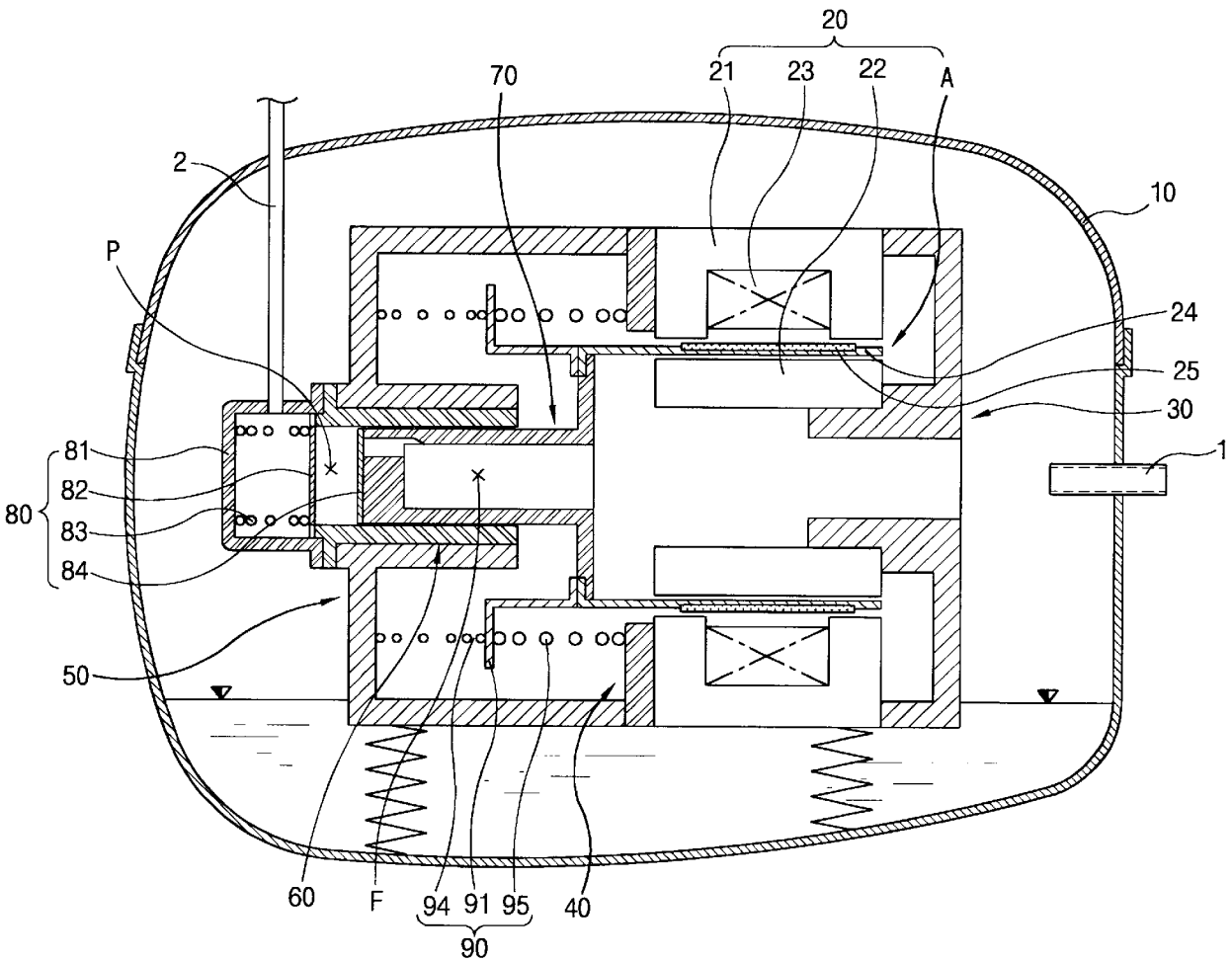
FIG. 3 is a vertical sectional view showing a reciprocating compressor including a piston support structure of a reciprocating compressor according to the present invention.

FIG. 3 shows a reciprocating compressor including an example of the piston support structure of the reciprocating compressor according to the present invention. Referring to FIG. 3, in the reciprocating compressor, a reciprocating motor 20 for generating linear reciprocating driving power is loaded in a container 10 having a predetermined inner space. A hind frame 30 and a central frame 40 are combined with both sides of the reciprocating motor 20.

The reciprocating motor 20 includes a cylindrical outer stator 21 fixedly combined with the hind frame 30 and the central frame 40, an inner stator 22 inserted into the outer stator 21 to be separated from the outer stator 21 by a predetermined distance, a winding coil 23 combined with the outer stator 21 inside the outer stator 21, a moving magnet A inserted between the outer stator 21 and the inner stator 22 to be movable in a linear reciprocating motion. The moving magnet A includes a cylindrical magnet holder 24 and a plurality of permanent magnets 25 combined with the magnet holder to be separated from each other by a predetermined distance.

A front frame 50 formed in a predetermined shape is combined with the central frame 40. A cylinder 60 is combined with a hole penetrating the front frame 50. The piston 70 is inserted into the cylinder 60. The piston 70 is combined with the magnet holder 24 of the moving magnet A that forms the reciprocating motor 20.

A compression space P is formed in the cylinder 60 into which the piston 70 is inserted. The cylinder 60 is separated from the reciprocating motor 20 by a predetermined distance. A resonance spring unit 90 for elastically supporting the motions of the moving magnet A of the reciprocating motor 20 and the piston 70 is included between the front frame 50 and the central frame 40.

Figure 4:
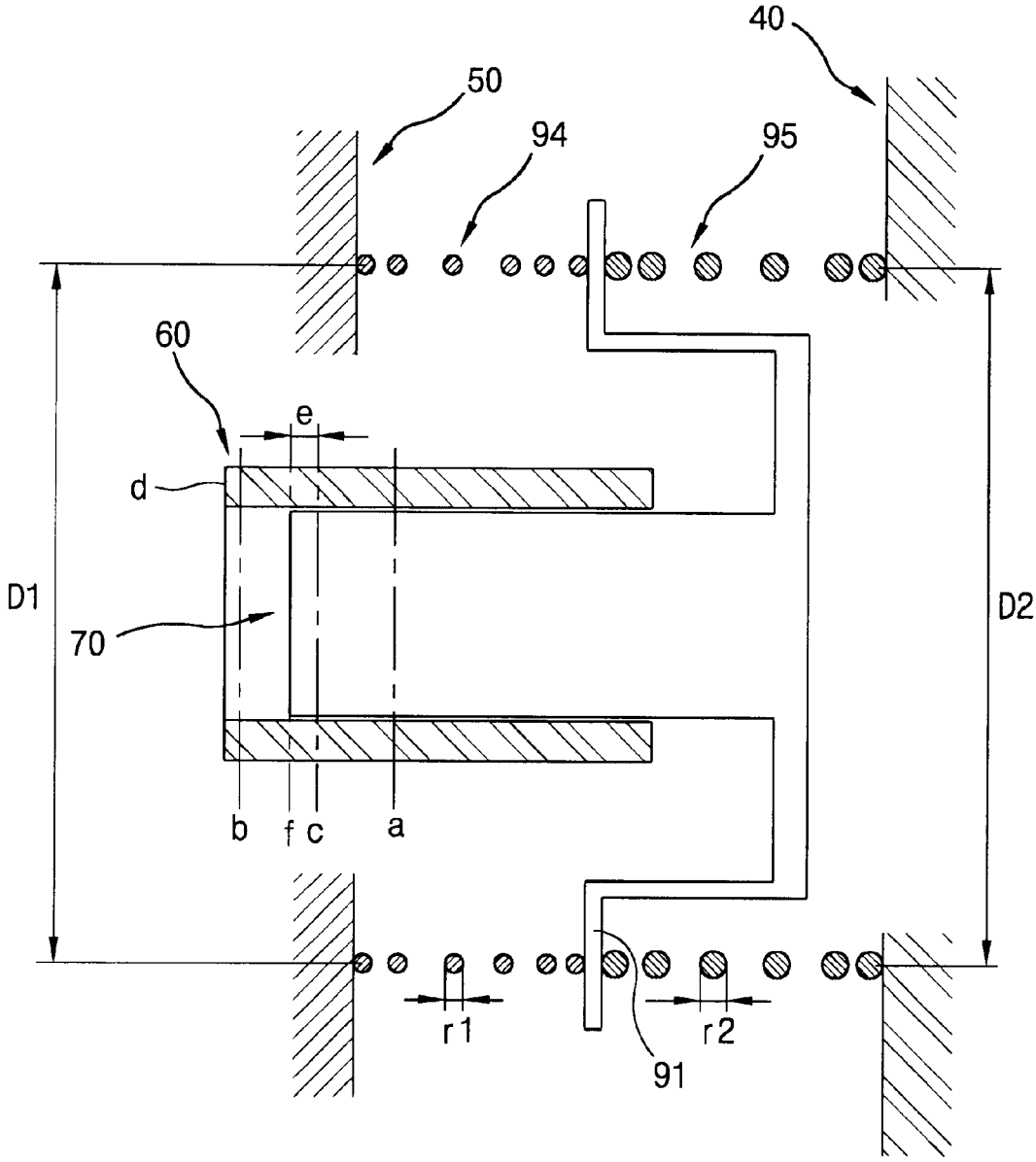
FIG. 4 is a sectional view showing the piston support structure of the reciprocating compressor according to the present invention.

As shown in FIG. 4, the resonant spring unit 90 includes a spring supporter 91, which is formed to be bent so as to have a predetermined area and whose one side is combined with the piston 70 so as to be positioned between the front frame 50 and the central frame 40, a first resonant spring 94 positioned between the front frame 50 and the spring supporter 91, and a second resonant spring 95 formed to have a spring constant larger than the spring constant of the first resonant spring 94 and positioned between the spring supporter 91 and the central frame 40.

The first resonant spring 94 is positioned on the side of the compression space P of the cylinder 60, and the first resonant spring 94 elastically supports the piston 70. The second resonant spring 95 is opposite to the first resonant spring 94, and the second resonant spring 95 elastically supports the piston 70.

The first resonant spring 94 and the second resonant spring 95 are combined with each other in a state where the first resonant spring 94 and the second resonant spring 95 are compressed to predetermined lengths, e.g., as in the conventional structure of the background art, so that the initial position f of the end of the piston 70 is moved from a center c between the maximum top dead center b and the maximum bottom dead center a toward the end d of the cylinder 60 by a predetermined distance, e.g., a movement distance e, considering the gas spring force generated during the compression of the refrigerant gas.

However, the second resonant spring 95 is combined with the first resonant spring 94 to be less compressed than the first resonant spring 94 by forming the second resonant spring 95 having the spring constant larger than the spring constant of the first resonant spring 94. Also, the first resonant spring 94 and the second resonant spring 95 are formed of coil springs.

The structure where the spring constant of the second resonant spring 95 is larger than the spring constant of the first resonant spring 94 will now be described.

In a first embodiment, the spring constant of the second resonant spring 95 is larger than the spring constant of the first resonant spring 94 by forming the wire diameter r2 of the second resonant spring 95 to be larger than the wire diameter r1 of the first resonant spring 94.

Figure 5:
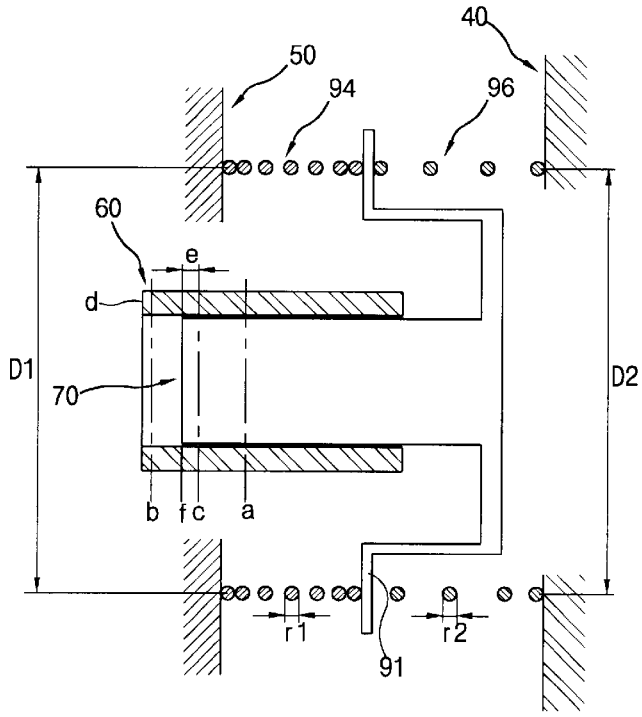
FIG. 5 is a sectional view showing another modification of the piston support structure of the reciprocating compressor according to the present invention.

In a second embodiment, as shown in FIG. 5, the first resonant spring 94 and a second resonant spring 96 are formed of the coil springs. The spring constant of the second resonant spring 96 is larger than the spring constant of the first resonant spring 94 by forming the number of times of winding of the second resonant spring 96 to be smaller than the number of times of winding of the first resonant spring 94.

Figure 6:
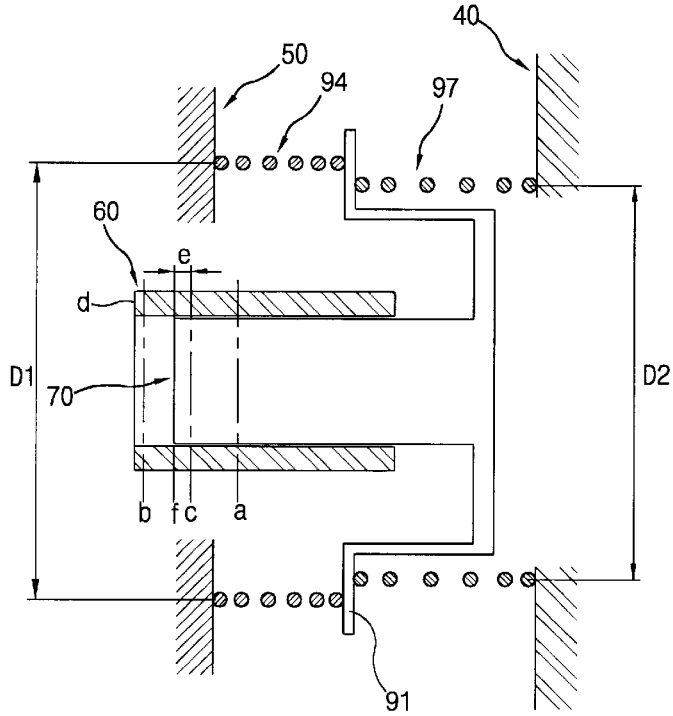
FIG. 6 is a sectional view showing another modification of the piston support structure of the reciprocating compressor according to the present invention.

In a third embodiment, as shown in FIG. 6, the first resonant spring 94 and a second resonant spring 97 are formed of the coil springs. The spring constant of the second resonant spring 97 is larger than the spring constant of the first resonant spring by forming the average diameter D2 of the second resonant spring 97 to be smaller than the average diameter D1 of the first resonant spring 94.

However, the spring constants of the second resonant springs 95, 96, and 97 are preferably formed to be larger than the spring constant of the first resonant spring 94 by applying the combination of three variables that determine the spring constant, that is, the wire diameters, the number of times of winding, and the effective diameters of the first resonant spring 94 and the second resonant springs 95, 96, and 97.

Figure 7:
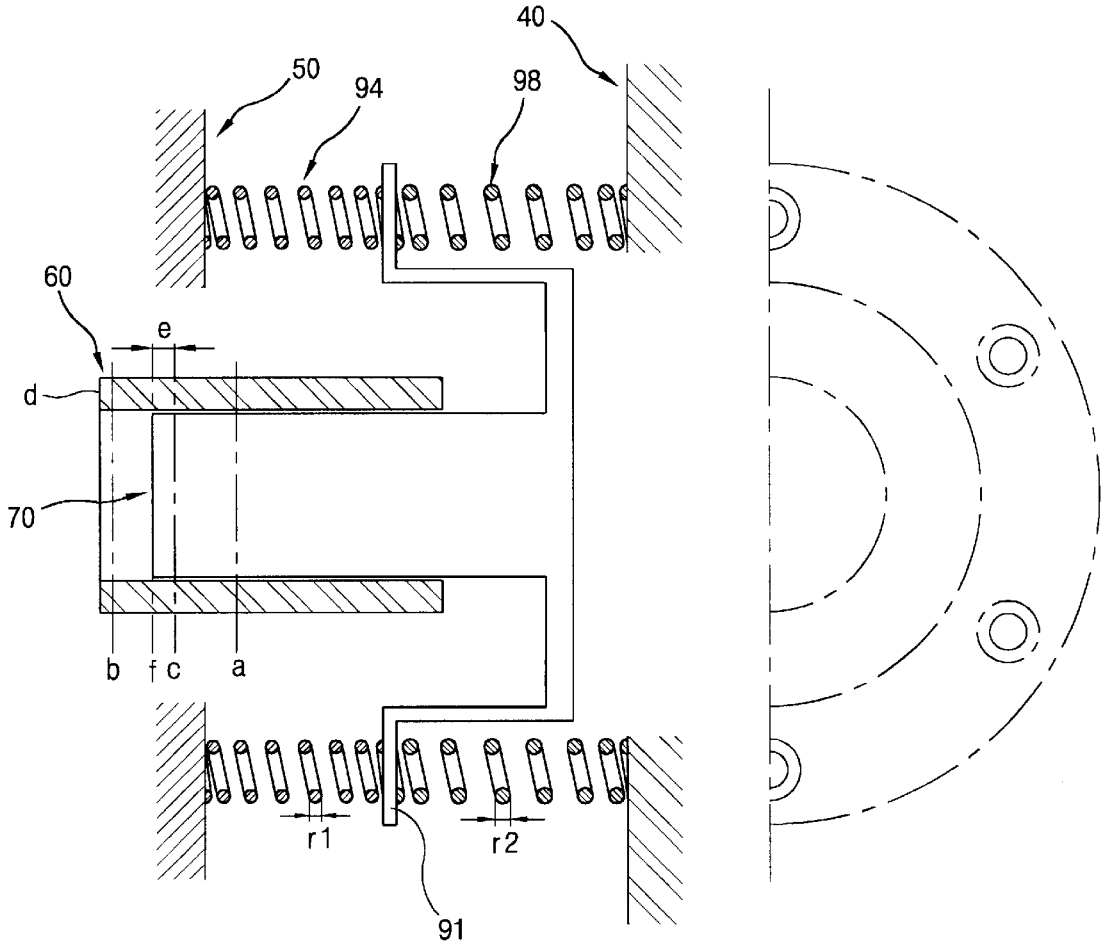
FIG. 7 is a sectional view showing another modification of the piston support structure of the reciprocating compressor according to the present invention.

In another embodiment of the resonant spring unit 90, the spring constant of the second resonant spring 98 can be formed to be larger than the spring constant of the first resonant spring 94 by forming the plurality :of first resonant springs 94 and a plurality of second resonant springs 98 as shown in FIG. 7 and varying the design variables of the springs as mentioned above.

The first resonant springs 94 are positioned on the side of the compression space P of the cylinder 60, and the first resonant springs 94 elastically support the piston 70. The second resonant springs 98 are opposite to the first resonant springs 94, and the second resonant springs 98 support the piston 70. The spring constants of the first resonant springs 94 are larger than the spring constants of the second resonant springs 98.

The spring constants of the second resonant springs 98 are made larger than the spring constants of the first resonant springs 94 by appropriately combining the variables such as the number of windings, the wire diameters, and the effective diameters of the first and second resonant springs as mentioned above. Also, the combination of the variables can be by forming a plurality of springs.

A valve unit 80 for sucking up gas into the cylinder 60 and discharging the gas into the outside of the cylinder 60 is combined with one side of the cylinder 60 due to the pressure difference caused by the piston 70 being in the linear reciprocating motion in the cylinder 60.

The valve unit 80 includes a discharge cover 81 for covering the compression space P of the cylinder 60 and a discharge valve 82 positioned in the discharge cover 81. The discharge valve 82 opens and closes the compression space P of the cylinder 60. The valve unit 80 also includes a valve spring 83 for elastically supporting the discharge valve 82, and a suction valve 84 combined with the end of the piston 70. The suction valve 84 is used for opening and closing a suction channel F formed in the piston 70.

Reference numeral 1 denotes a suction pipe into which the refrigerant gas is sucked up. Reference numeral 2 denotes a discharge pipe into which the compressed refrigerant gas is discharged.

The operation and effects of the piston support structure of the reciprocating compressor according to the present invention will now be described.

When power is supplied to drive the reciprocating motor 20, the linear reciprocating driving power of the reciprocating motor 20 is transmitted to the piston 70 through the moving magnet A. Accordingly, the piston 70 is in a linear reciprocating motion by the distance between the top dead center and the bottom dead center, e.g., the stroke of the piston 70 in the compression space P formed in the cylinder 60. The stroke of the piston 70 is performed by the electrical control of the reciprocating motor 20.

When the piston 70 is in the linear reciprocating motion in the compression space P formed in the cylinder 60, the valve unit 80 operates together with the linear reciprocating motion of the piston 70. The refrigerant gas is sucked up into the compression space P formed in the cylinder 60 and is compressed. The compressed refrigerant gas is discharged into the outside of the cylinder 60. The above processes are repeated.

The piston 70 receives the linear reciprocating driving power of the reciprocating motor 20 and is in the linear reciprocating motion in the compression space P formed in the cylinder 60. Accordingly, the first resonant spring 94 and the second resonant springs 95, 96, 97, and 98 store the linear reciprocating driving power of the reciprocating motor 20 as elastic energy and emit the elastic energy while contracting and being relaxed. The first resonant spring 94 and the second resonant springs 95, 96, 97, and 98 cause the resonant motions of the moving magnet A and the piston 70.

When the piston 70 is positioned in the top dead center, the first resonant spring 94 contracts and the second resonant springs 95, 96, 97, and 98 are extended to be longer than the initial setting length. When the piston 70 is positioned in the bottom dead center, the first resonant spring 94 is extended to be longer than the initial setting length and the second resonant springs 95, 96, 97, and 98 contract. Accordingly, the first resonant spring 94 and the second resonant springs 95, 96, 97, and 98 elastically support the piston 70 and the moving magnet A.

During the process of sucking up the refrigerant gas into the compression space P formed in the cylinder 60 and compressing the sucked up refrigerant gas, the gas spring force is generated when the refrigerant gas is compressed by the piston 70. Accordingly, the piston 70 receives force in the direction of the maximum bottom dead center a.

Accordingly, the gas spring force applied to the piston 70 moves the piston 70 to the direction of the second resonant springs 95, 96, 97, and 98 by the movement distance e, by which the piston 70 is moved when the piston 70 is initially loaded. Therefore, the piston 70 is in the linear reciprocating motion centering on the center c between the maximum top dead center b and the maximum bottom dead center a shown in FIG. 4.

Since the second resonant springs 95, 96, 97, and 98 are loaded in a state of being compressed to be smaller than the first resonant spring 94 during the initial assembly, the compressing displacements of the second resonant springs 95, 96, 97, and 98 become smaller than the compressing displacement of the first resonant spring 93 in the conventional structure. Accordingly, the stress applied to the second resonant springs 95, 96, 97, and 98 is reduced. Also, uniform stress is applied to the first and second resonant springs.

As mentioned above, in the piston support structure of the reciprocating compressor according to the present invention, the stress concentration of the second resonant springs for elastically supporting the piston is reduced. Accordingly, it is possible to prevent the endurance of the second resonant springs from deteriorating due to the fatigue of the second resonant springs. Therefore, it is possible to extend the durability of the resonant springs and to improve the reliability of the reciprocating compressor.

What is claimed is:

1. A piston support structure for a reciprocating compressor comprising:

a reciprocating motor;

a front frame, a central frame and a rear frame;

a piston receiving a linear, reciprocating driving force generated by the reciprocating motor, said piston being in a linear reciprocating motion within a compression space formed in a cylinder;

a resonant spring unit having a bent spring supporter positioned between the front frame and the central frame and operatively connected to said reciprocating motor, a plurality of first resonant springs and a plurality of second resonant springs, said first and said second resonant springs being positioned on a first side and a second side of the bent spring supporter, respectively, wherein the first resonant springs and the second resonant springs elastically support the linear reciprocating motion of the piston, and spring constants of the second resonant springs is larger than spring constants of the first resonant springs, said first resonant springs being positioned on a compression space side of the cylinder, and said second resonant springs being positioned opposite to said first resonant springs.

* * * * *